US008052435B1

(12) United States Patent
Wang et al.

(10) Patent No.: US 8,052,435 B1
(45) Date of Patent: Nov. 8, 2011

(54) CONNECTOR

(75) Inventors: Hung-Chi Wang, Taipei (TW); Mei-Chuan Yang, Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 12/963,614

(22) Filed: Dec. 8, 2010

(51) Int. Cl.
*H01R 12/00* (2006.01)

(52) U.S. Cl. ..... 439/83; 439/876

(58) Field of Classification Search ..... 439/83, 439/874, 876
See application file for complete search history.

(56) References Cited

U.S. PATENT DOCUMENTS 5,908,335 A * 6/1999 Satoh ..... 439/857
6,280,240 B1 * 8/2001 Chang ..... 439/495
7,654,868 B1 * 2/2010 Wang et al. ..... 439/630
7,927,120 B1 * 4/2011 Wang et al. ..... 439/328
2008/0085616 A1 * 4/2008 Hirai et al. ..... 439/83

* cited by examiner

*Primary Examiner* — James Harvey

(57) ABSTRACT

A connector soldered to a PCB has an insulating housing of which two opposite ends recessed to form a pair of receiving recesses, terminals mounted in the insulating housing having soldering portions projected out of a bottom of the insulating housing, a positioning member. The positioning member has a base slice received in the receiving recess, a side edge of the front of the base slice extending downward and then being bent perpendicularly to form a soldering slice located to be lower than the bottom of the base for being soldered with the PCB. As the thickness of the base slice is less than the height of the receiving recess, intervals are accordingly formed between the positioning member and the top and bottom sides of the receiving recess to achieve an up-and-down movement of the positioning member.

5 Claims, 4 Drawing Sheets

CONNECTOR

BACKGROUND OF THE INVENTION

1. Field of the Invention

The present invention relates to a connector, and more particularly to a connector capable of ensuring a steady connection between terminals thereof and a printed circuit board (PCB).

2. The Related Art

FIG. 4 shows a conventional connector 60 soldered with a PCB. The connector 60 has an insulating housing 61, a plurality of first terminals 62 and second terminals 63 mounted in the insulating hosing 61 and each having a soldering portion (not labeled) projecting out of the insulating housing 61 for being soldered on the PCB, and a pair of fixing members 64 protruded forward from two opposite ends of a front of the insulating housing 61. Bottoms of the two fixing members 64 extend towards each other to form a pair of positioning portions 641 soldered on the PCB. However, as the positioning portion 641 is molded with the fixing member 64 together, the soldering portions of the terminals 62, 63 may not be level with the positioning portions 641. As a result, there may be some soldering portions failing to be soldered with the PCB, and a poor connection is caused between the connector 60 and the PCB.

SUMMARY OF THE INVENTION

Accordingly, an object of the present invention is to provide a connector soldered with a PCB. The connector has an insulating housing, a plurality of terminals assembled in the insulating housing, a positioning member. The insulating housing has a base of which two opposite ends of a front side recessed rearward to form a pair of receiving recesses. Each of the terminals has a soldering portion projecting out of a bottom of the base for being soldered on the PCB. The positioning member movably mounted to the insulating housing has a base slice inserted in the receiving recess with a front thereof projecting beyond the front side of the base. A side edge of the front of the base slice extends downward and then is bent perpendicularly to form a soldering slice located to be lower than the bottom of the base for being soldered with the PCB. As the thickness of the base slice is less than the height of the receiving recess to accordingly form intervals between the base slice and a top and bottom sides of the receiving recess so that the positioning member capable of having an up-and-down movement of in order to adjust a relative position between the soldering slice and the soldering portions of the terminals.

As described above, as the thickness of the base slice is less than the height of the receiving recess, the intervals are accordingly formed between the positioning member and the top and bottom sides of the receiving recess to make the positioning member up-and-down movable for further adjusting the soldering slice to keep level with the soldering portions of the terminals. So, the connector is able to keep the soldering portions of the terminals being soldered with the PCB even when there is tolerance in production.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
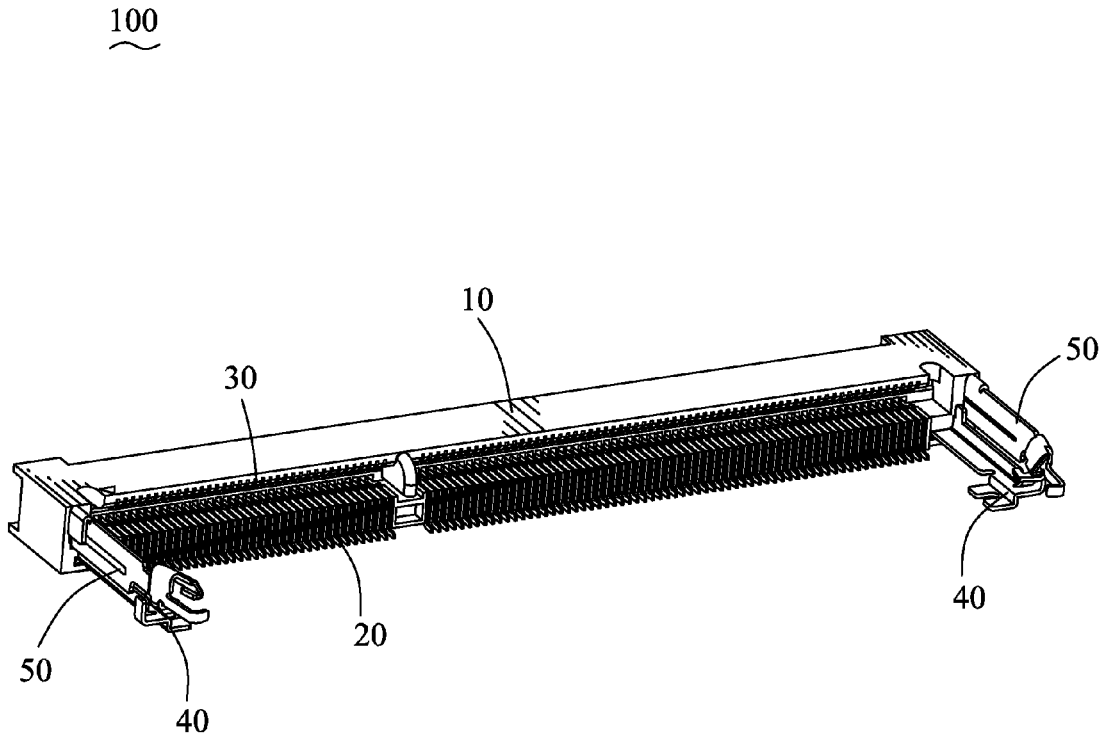
FIG. 1 is an assembled, perspective view of a connector of an embodiment in accordance with the present invention.
Figure 2:
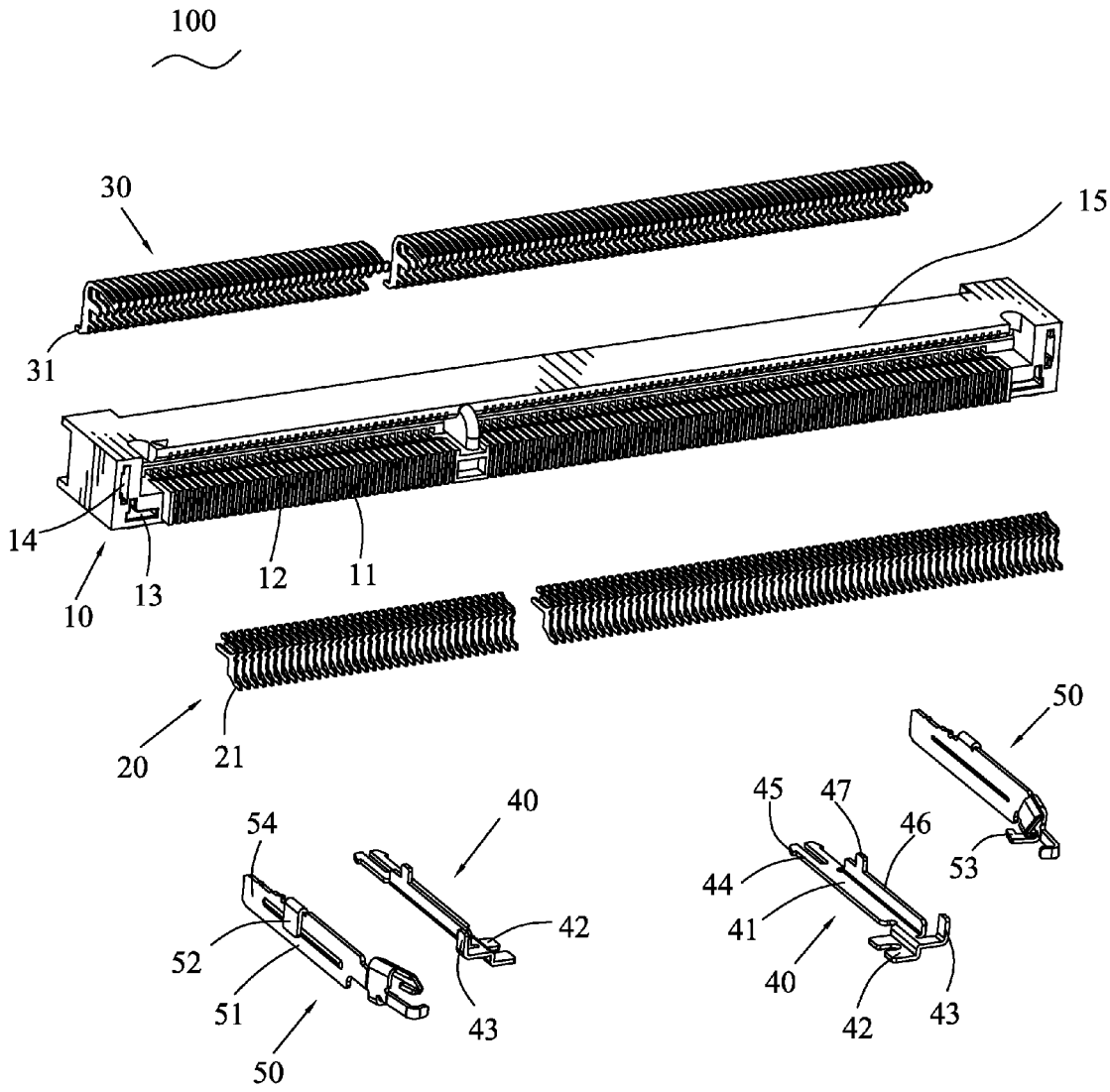
FIG. 2 is an exploded, perspective view of the connector shown in FIG. 1.
Figure 3:
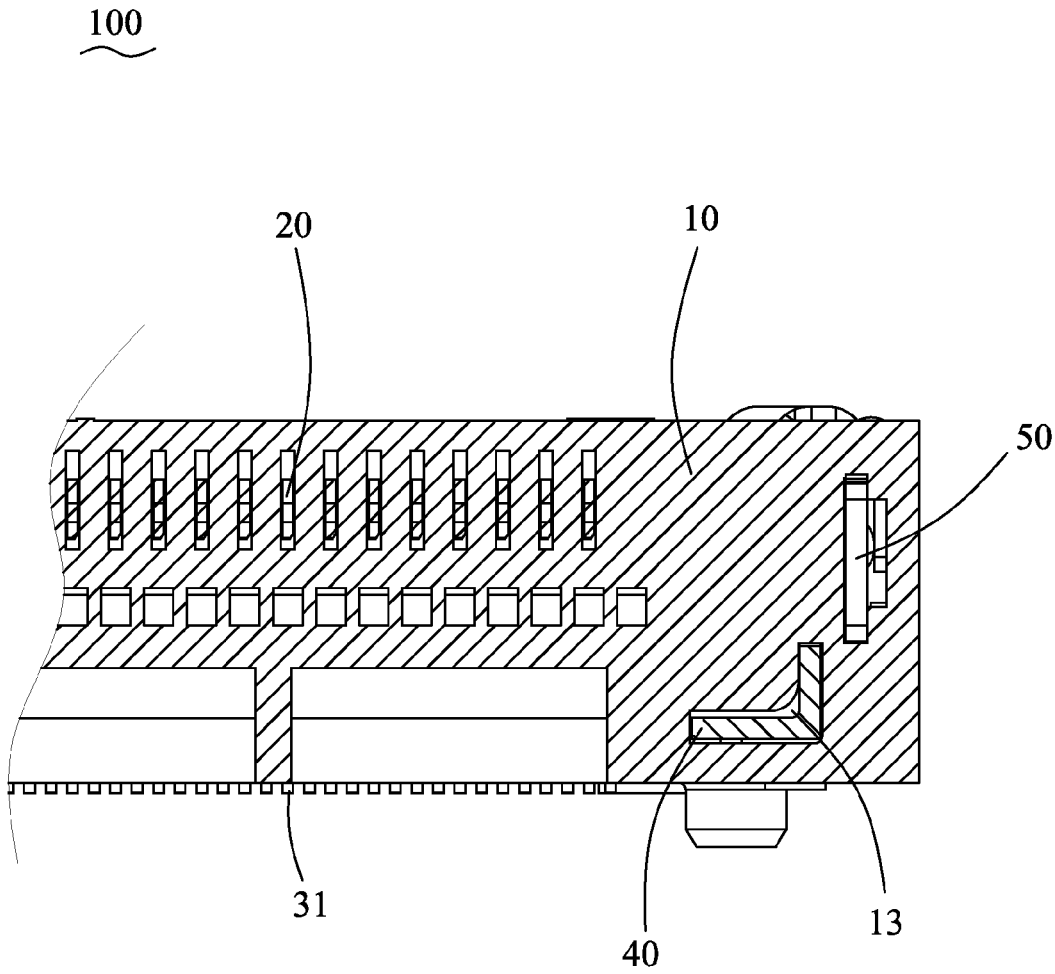
FIG. 3 is an assembled, cross-sectional view of the connector shown in FIG. 1.
Figure 4:
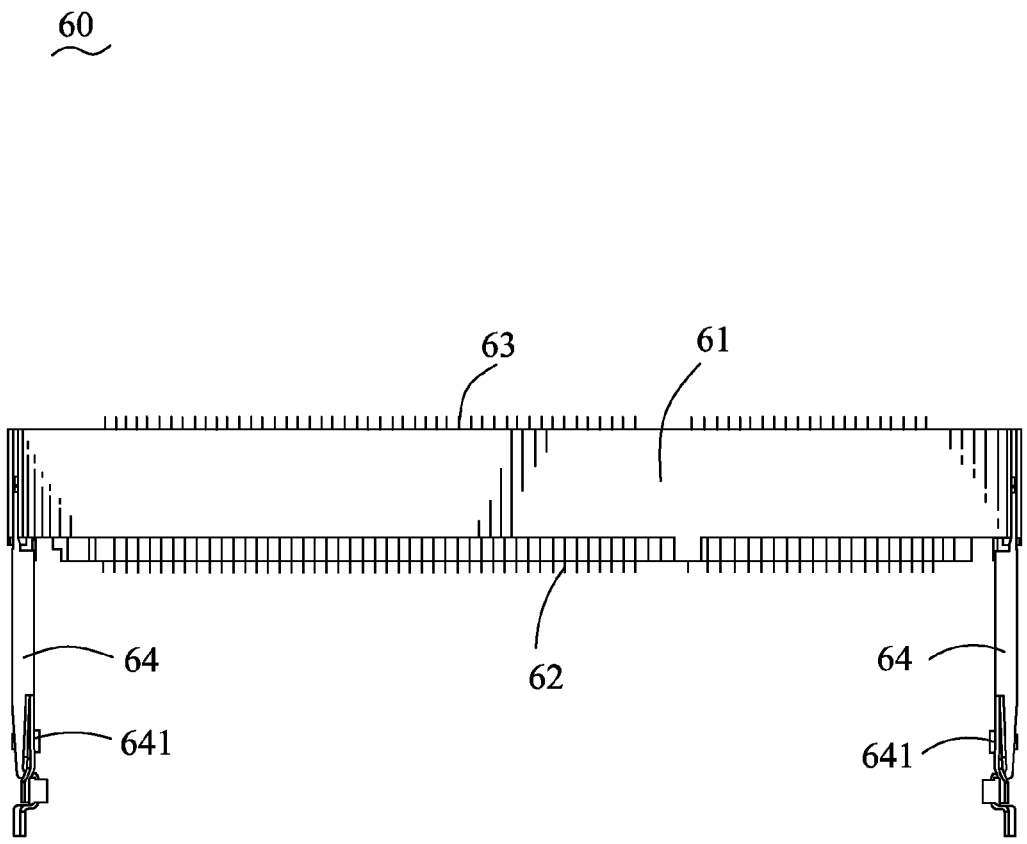
FIG. 4 (Prior Art)
FIG. 4 is a perspective view showing a conventional connector.

Referring to the drawings in greater detail, and first to FIGS. 1-2, the embodiment of the invention is embodied in a connector 100. The connector 100 has an insulating housing 10, a plurality of first terminals 20 and second terminals 30 mounted in the insulating housing 10, a pair of positioning members 40 movably mounted to two opposite ends of the insulating housing 10, and a pair of latch members 50 assembled to the two opposite ends of the insulating housing 10.

With reference to FIGS. 1-2, the insulating housing 10 has a long rectangular base 15. A lower part of a front of the base 15 defines a plurality of first terminal grooves 11 arranged at regular intervals along a longwise direction thereof. An upper portion of the base 15 defines a plurality of second terminal grooves 12 arranged at regular intervals along the longwise direction thereof. Two opposite ends of the front of the base 15 each has an upper portion recessed rearward to form a fixing recess 14, and a lower portion recessed rearward to form a receiving recess 13 penetrating a rear of the base 15. The fixing recess 14 and the corresponding receiving recess 13 are substantially perpendicular to each other to show a substantial L-shape together.

The first terminals 20 are disposed in the corresponding first terminal grooves 11, and each has a first soldering portion 21 projecting out of a bottom of the base 15 for being soldered with a PCB (not shown). The second terminals 30 are respectively disposed in the second terminal grooves 12, and each has a second soldering portion 31 projecting out of the bottom of the base 15 for being soldered with the PCB.

The latch member 50 has a long rectangular base plate 51. A rear edge of the base plate 51 extends rearward to form a fixing plate 54 press fitted in the fixing recess 14 of the insulating housing 10 with the base plate 51 projecting out of the front of the base 15. A portion of a top edge of the base plate 51 adjacent to the fixing plate 54 extends sideward and then is bent downward to form a folded plate 52 apart facing the base plate 51 and resting against the front of the base 15. Frond ends of two bottom edges of the two base plates 51 protrude towards each other and then are bent rearward to form a stopping portion 53 of substantially L-shape respectively.

The positioning member 40 has a base slice 41 having a rear portion extending rearward to form a buckling portion 44 of substantially lying U-shape. The buckling portion 44 has two free ends oppositely protruded outward to form a pair of wedges 45. One side edge of the base slice 41 extends upward to form a side slice 46. The side slice 46 has a rear portion thereof further extending upward to form a bump 47. A front end of the one side edge of the base slice 41 further protrudes outward and then extends upward to form a restraining portion 43 adjacent to the side slice 46. The other side edge of the base slice 41 is punched downward and then extends perpendicularly to form a soldering slice 42. In assembly, the buckling portion 44 is inserted rearward into the receiving recess 13 until the bump 47 rests against the front of the base 15. At this time, the wedges 45 are grappled with a rear side of the base 15 for preventing the positioning member 40 moving frontward. The base slice 41 projects beyond the front of the base 15 with the soldering slice 42 located to be lower than the bottom of the base 15 for being soldered with the PCB. As the thickness of the base slice 41 is less than the height of the receiving recess 13, intervals are accordingly formed between the positioning member 40 and a top and bottom sides of the receiving recess 13. So, the positioning member 40 is capable of moving up-and-down so as to adjust a relative position of the soldering slice 42 and the soldering portions 21, 31 of the terminals 20, 30. The restraining portion 43 is engaged with the stopping portion 53 for avoiding the deformation of the front of the latch member 50 while an external card (not shown) is inserted into the connector 100.

As described above, as the thickness of the base slice 41 is less than the height of the receiving recess 13, the intervals are accordingly formed between the positioning member 40 and the top and bottom sides of the receiving recess 13 to make the positioning member 40 up-and-down movable for further adjusting the soldering slice 42 to keep level with the soldering portions 21, 31 of the terminals 20, 30. So, the connector 100 is able to keep the soldering portions 21, 31 of the terminals 20, 30 being soldered with the PCB even when there is tolerance in production.

What is claimed is:

1. A connector soldered to a PCB, comprising:

an insulating housing having a base of which two opposite ends of a front side recessed rearward to form a pair of receiving recesses;

a plurality of terminals assembled in the base of the insulating housing, each of the terminals having a soldering portion projecting out of a bottom of the base for being soldered on the PCB; and a positioning member movably mounted to the insulating housing having a base slice inserted in the receiving recess with a front thereof projecting beyond the front side of the base, one side edge of the front of the base slice extending downward and then being bent perpendicularly to form a soldering slice located to be lower than the bottom of the base for being soldered with the PCB, wherein the thickness of the base slice is less than the height of the receiving recess to accordingly form intervals between the base slice and a top and bottom sides of the receiving recess so that the positioning member is capable of having an up-and-down movement in order to adjust a relative position between the soldering slice and the soldering portions of the terminals.

2. The connector as claimed in claim 1, further comprising a latch member having a base plate, a rear of the base plate extending rearward to form a fixing portion which is press fitted in a fixing recess opened in one end of the front side of the insulating housing, a frond end of a bottom edge of the base plate protruding towards the positioning member and then being bent rearward to form a stopping portion of substantially L-shape, a front end of the other side edge of the base slice near to the latch member protruding towards the stopping portion and then being bent upward to form a restraining portion engaged with the stopping portion for avoiding the deformation of the front of the latch member.

3. The connector as claimed in claim 2, wherein a portion of a top edge of the base plate adjacent to the fixing portion extends sideward and then is bent downward to form a folded plate resting against the front side of the base for preventing the latch member further going into the fixing recess.

4. The connector as claimed in claim 1, wherein a rear end of the base slice of the positioning member further extends rearward to form a buckling portion of substantially lying U-shape having two free ends oppositely protruded outward to form a pair of wedges, the buckling portion is inserted in the receiving recess with the wedges being grappled with a rear side of the base for preventing the positioning member moving frontward with respect to the insulating housing.

5. The connector as claimed in claim 1, wherein the other side edge of the base slice extends upward to form a side plate having a rear portion thereof further protruded upward to form a bump, the bump rests against the front side of the base for preventing the positioning member further moving into the insulating housing.

* * * * *